US011365511B2

(12) United States Patent
Gelus et al.

(10) Patent No.: US 11,365,511 B2
(45) Date of Patent: Jun. 21, 2022

(54) STEAMING APPLIANCE

(71) Applicant: SEB S.A., Ecully (FR)

(72) Inventors: Dominique Gelus, Ecully (FR); David Castebert, Lyons (FR)

(73) Assignee: SEB S.A.

( * ) Notice: Subject to any disclaimer, the term of this patent is extended or adjusted under 35 U.S.C. 154(b) by 239 days.

(21) Appl. No.: 16/655,929

(22) Filed: Oct. 17, 2019

(65) Prior Publication Data

US 2020/0123699 A1 Apr. 23, 2020

(30) Foreign Application Priority Data

Oct. 18, 2018 (FR) ..... 1871215

(51) Int. Cl.
*D06F 75/12* (2006.01)
*D06F 75/20* (2006.01)
(Continued)

(52) U.S. Cl.
CPC ..... *D06F 75/12* (2013.01); *D06F 75/20* (2013.01); *D06F 75/24* (2013.01); *D06F 75/26* (2013.01);
(Continued)

(58) Field of Classification Search
CPC . D06F 75/00–40; D06F 87/00; D06F 2105/28
See application file for complete search history.

(56) References Cited

U.S. PATENT DOCUMENTS 5,315,773 A * 5/1994 Iwami ..... D06F 75/12 219/247
5,638,622 A * 6/1997 Hohn ..... D06F 75/18 38/77.5
(Continued)

FOREIGN PATENT DOCUMENTS

ES 2403784 A2 5/2013
FR 3060027 A1 6/2018
(Continued)

OTHER PUBLICATIONS

French Search Report for Application No. FR1871215 dated Jul. 3, 2019, 2 pages.

*Primary Examiner* — Ismael Izaguirre
(74) *Attorney, Agent, or Firm* — Lerner, David, Littenberg, Krumholz & Mentlik, LLP

(57) ABSTRACT

In one embodiment, the present disclosure relates to a steam pressing appliance that includes a handle connected to a steam release nozzle. The steam release nozzle includes a heating body with an instant vaporization chamber and an electrical resistor regulated by a thermostat in order to keep the temperature of the vaporization chamber around a set-point temperature. The appliance also includes an electric pump to inject liquid into the vaporization chamber. The pump is controlled by a drive circuit that receives information from the thermostat on whether power is being supplied to the electrical resistor. The drive circuit modifies the operating conditions of the pump in accordance with whether or not current is supplied through the electrical resistor, operating in a first flow mode when current flows through the electrical resistor and operating in a second flow mode when no current flows through the electrical resistor.

20 Claims, 5 Drawing Sheets

(51) Int. Cl.

| | |
|---|---|
| ***D06F 75/24*** | (2006.01) |
| ***D06F 75/26*** | (2006.01) |
| ***D06F 75/30*** | (2006.01) |
| ***D06F 87/00*** | (2006.01) |
| *D06F 105/28* | (2020.01) |

(52) U.S. Cl.
CPC ..... *D06F 75/30* (2013.01); *D06F 87/00* (2013.01); *D06F 2105/28* (2020.02)

(56) References Cited

U.S. PATENT DOCUMENTS

| | | | | |
|---|---|---|---|---|
| 5,842,295 | A * | 12/1998 | Ching | D06F 75/12 38/77.6 |
| 6,438,876 | B2 * | 8/2002 | Har | D06F 75/18 38/77.7 |
| 2005/0282726 | A1 * | 12/2005 | Carswell | D06M 13/355 510/470 |
| 2016/0037990 | A1 * | 2/2016 | McDowell | A47L 11/4086 134/18 |
| 2016/0168778 | A1 * | 6/2016 | Wadhwa | D06F 75/26 38/77.83 |

FOREIGN PATENT DOCUMENTS

| | | | |
|---|---|---|---|
| JP | 08131696 | A * | 5/1996 |
| WO | 2016090538 | A1 | 6/2016 |

* cited by examiner

STEAMING APPLIANCE

CROSS-REFERENCE TO RELATED APPLICATIONS

This application claims the benefit of the filing date of French Patent Application No. 1871215, filed Oct. 18, 2018, the disclosure of which is hereby incorporated herein by reference.

TECHNICAL FIELD

The present disclosure is within the field of steam ironing/pressing appliances. In some embodiments, the appliance includes a handle connected to a steam release nozzle with a treatment head designed to vertically face a garment from which the creases are to be removed, and further includes at least one steam output hole.

More specifically, certain embodiments of the present disclosure relate to an appliance in which the steam release nozzle includes a heating body, an instant vaporization chamber within the heating body, and an electrical resistor regulated by a thermostat in order to keep the temperature in the vaporization chamber around a set-point temperature. Further, the appliance includes an electric pump to inject liquid into the vaporization chamber.

BACKGROUND OF THE INVENTION

One example of a steaming appliance within the technical field is described in French patent application FR 3 060 027 (the '027 application).

The appliance of the '027 application, equipped with an instant vaporization chamber in which the water is injected by an electric pump, is advantageous in that it provides high steam flow. However, under certain conditions, it is possible to observe discarded water, particularly after the nozzle has been used while tipped on its side. Indeed, under these conditions, part of the heating element does not come into contact with the water, and as a result, the thermostat frequently stops heating. Under these conditions, with the power supply to the heating element cut, the water quickly accumulates in the vaporization chamber. Then, when the thermostat turns on, the significant force provided by the heating element quickly generates a powerful flow of steam, as a result of part of the water that accumulated in the vaporization chamber being vaporized, thus causing water droplets produced from water accumulated in the vaporization chamber to be released through the steam output holes.

BRIEF SUMMARY OF THE INVENTION

The present disclosure aims to redress the above described disadvantages by proposing a steaming appliance that produces a significant flow of steam, which can also be used in all positions, while furthermore reducing the risk of water droplets spitting out of the steam output hole.

The aim of the disclosure is achieved, for example, by a steam ironing/pressing appliance as described herein. In one embodiment, a steaming appliance includes a handle connected to a steam release nozzle. The seam release nozzle includes a treatment head with at least one steam output hole designed to be used vertically in relation to a garment from which the creases are to be removed. The steam release nozzle also includes a heating body with an instant vaporization chamber and an electrical resistor regulated by a thermostat in order to keep the temperature of the vaporization chamber around a set-point temperature. The appliance includes an electric pump to inject liquid into the vaporization chamber, characterized in that the pump is controlled by a drive circuit, which receives information on the current supplied to the electrical resistor by the thermostat. The drive circuit furthermore modifies the operating conditions of the pump in accordance with the electrical resistor power supply, with the pump operating in a first flow mode when a current flows through the electrical resistor and with the pump operating in a second flow mode when no current flows through the electrical resistor. Of the two flow modes, the flow of steam is weaker in the second flow mode than in the first flow mode.

The characteristics of the appliance make it possible to limit the flow of water injected into the vaporization chamber when current no longer flows through the electrical resistor. This therefore reduces the amount of water sent into the vaporization chamber when the energy with which to vaporize the water cannot flow through the electrical resistor, which in turn makes it possible to reduce the risk of water droplets spitting out with the flow of steam. Likewise, in reverse, when electricity flows through the electrical resistor, the power available can advantageously be used to increase the pump's flow and produce more steam, without the risk of water accumulating in the vaporization chamber.

The term "thermostat" as used herein encompasses all regulatory devices, whether mechanical, electric or electrical, that make it possible to keep the temperature near a predetermined value or within a predetermined range.

The term "pump flow" refers to the average flow of the pump over time. This flow may be produced by either constant pump operation or intermittent pump operation. In one example, intermittent pump operation may be achieved through the use of a time wheel set to a particular period of time.

According to a beneficial characteristic of the disclosure, some embodiments of the appliance include a button connected to the pump's drive circuit, which makes it possible to start/stop pump operation.

Because the button enables the user to control the appliance's steam output, the user can easily stop the steam flow when it is no longer needed.

According to another beneficial characteristic of the disclosure, some embodiments of the appliance include a button in the form of a trigger that maintains pump operation while it is activated, with release of the trigger resulting in pump operation coming to a stop.

The trigger facilitates a highly ergonomic user experience while operating the appliance.

According to another beneficial characteristic of the disclosure, some embodiments of the appliance have a second pump operation mode that is activated using a time wheel to control the pump's power supply. In some embodiments, another mechanism to control the power supply of the pump may be used.

The mechanism to control the power supply of the pump makes it possible to reduce pump flow simply and efficiently.

According to another beneficial characteristic of the disclosure, some embodiments of the appliance include a pump with a second flow mode that produces an output of less than 75%, and preferably less than 50%, of the flow released in the pump's first mode.

Limiting the flow in the above manner consequently and greatly limits the risk of water accumulating in the vaporization chamber.

According to a further beneficial characteristic of the disclosure, some embodiments of the appliance include a first flow mode that produces an output between 20 and 50 g/min.

The above referenced flow modes provide very good ironing/pressing capacity with the help of the steam flow.

According to yet another beneficial characteristic of the disclosure, some embodiments of the appliance include a vaporization chamber that protrudes into the center of a compartment in the heating body, whereby the compartment creates a distribution circuit around the vaporization chamber.

According to yet another beneficial characteristic of the disclosure, some embodiments of the appliance include a treatment head that is supported by an end plate located on the longitudinal edge of the head, with the handle extending across the nozzle.

According to yet another beneficial characteristic of the disclosure, some embodiments of the appliance include a heating body that has a front side which comes into contact with the end plate, whereby the front side comprises a light that connects the steam output hole on the treatment head with the heating body compartment.

The above referenced heating body makes it possible to thermally couple the treatment head with the heating body in order to keep the temperature of the treatment head at a temperature that exceeds 100° C. and in order to prevent steam from condensing on the treatment head.

According to yet another characteristic of the disclosure, some embodiments of the appliance include a portable case for the nozzle, handle, heating body, pump, drive circuit and a fluid reservoir.

The above referenced construction makes it possible to produce a compact appliance that gives very good steaming results while minimizing drip due to liquids in the chamber that remain unevaporated.

In one aspect, the present disclosure relates to a method of using a steam pressing appliance. In one embodiment, the method includes the following steps: supplying power to a circuit that includes a resistor connected to a heating body of the appliance, the supply of power providing current through the heating body to raise a temperature of the heating body; controlling the temperature of the heating body with a thermostat in communication with the heating body, a temperature value of the thermostat being compared with a predetermined temperature range to determine whether to supply current through the resistor so that the temperature value of the heating body is maintained within the predetermined temperature range; responding to actuation of a control mechanism by activating a pump connected to the heating body, the pump operating at a first flow rate if current is passing through the resistor and operating at a second flow rate lower than the first flow rate if no current is passing through the resistor; and producing steam through evaporation of fluid within the heating body, the fluid supplied to the heating body by the pump.

BRIEF DESCRIPTION OF THE DRAWINGS

The present disclosure will be better understood on reading the following detailed description of non-limiting embodiments thereof, and on examining the accompanying drawings, in which.

Only those elements required in order to understand the disclosure have been depicted. In order to facilitate interpretation of the drawings, the same elements are labeled with the same reference numerals across all the figures.

DETAILED DESCRIPTION

In this document, the terms "horizontal," "vertical," "lower," "upper," "front," "rear," "bottom," and "lid" are used to describe the steaming appliance when it is sitting flat on its feet.

Figure 1:
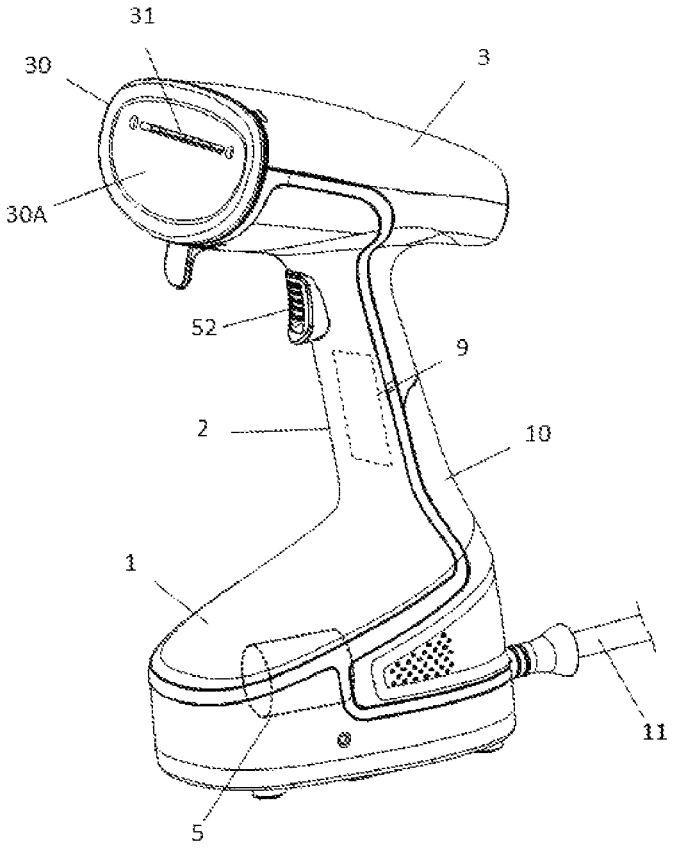
FIG. 1 is a perspective view of a pressing appliance according to a specific embodiment of the disclosure.

In one aspect, the present disclosure relates to a steaming/pressing appliance apparatus. FIG. 1 represents one embodiment of a pressing appliance that includes a portable case made of plastic. The portable case includes a base plate 1 mounted onto a handle 2 and a steam release nozzle 3, whereby the base plate 1 comprises a flat lower side equipped with feet upon which the appliance may be set stably in a substantially vertical position.

The base plate 1 of the appliance comprises a power supply cord 11, which makes it possible to connect the appliance to a household electricity network. The steam release nozzle 3 includes a rear side equipped with a button 4, which can be seen in FIG. 2, that makes it possible to turn the appliance on/off.

The base plate 1 contains an electric pump 5, illustrated with a dotted line in FIG. 1, whereby the operation thereof is controlled by a drive circuit made up of a trigger 52 and an electronic power supply board 9. The trigger 52 is advantageously placed at the top of the handle 2 and operates a switch connected to the power supply board 9 in order to turn the pump 5 on when the trigger 52 is pressed and turn the pump 5 off when the trigger 52 is released. Fluid is fed into the pump 5 by a reservoir 10, which is partially housed in the base plate 1 and in the lower portion of the handle 2, whereby this reservoir 10 may advantageously be detached from the device in order to facilitate the filling thereof.

The steam release nozzle 3 is slender, extends across the length of the handle 2 and includes a longitudinal end equipped with a flat end plate 30 that has a treatment head 30A designed to be used vertically in relation to a garment from which the creases are to be removed. The end plate 30 includes a slot 31 through which the flow of steam is released.

Figure 2:
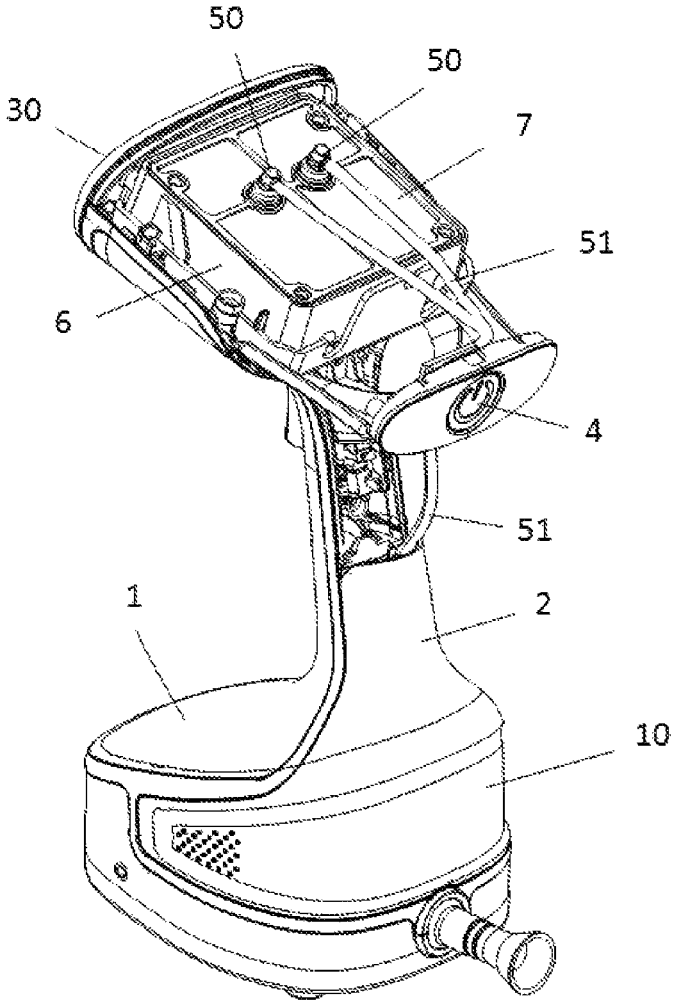
FIG. 2 is another perspective view of the appliance shown in FIG. 1, without one part of the case covering the appliance nozzle.

In accordance with FIG. 2, the steam 3 release nozzle contains a heating body 6 which is closed at its upper end by a lid 7 receiving two buses 50 that are connected, by means of a Y shaped silicone bar 51, to the pump 5, with the heating body 6 generally being rectangular parallelepiped in shape and having a front face that comes into thermal contact with the end plate 30.

Figure 3:
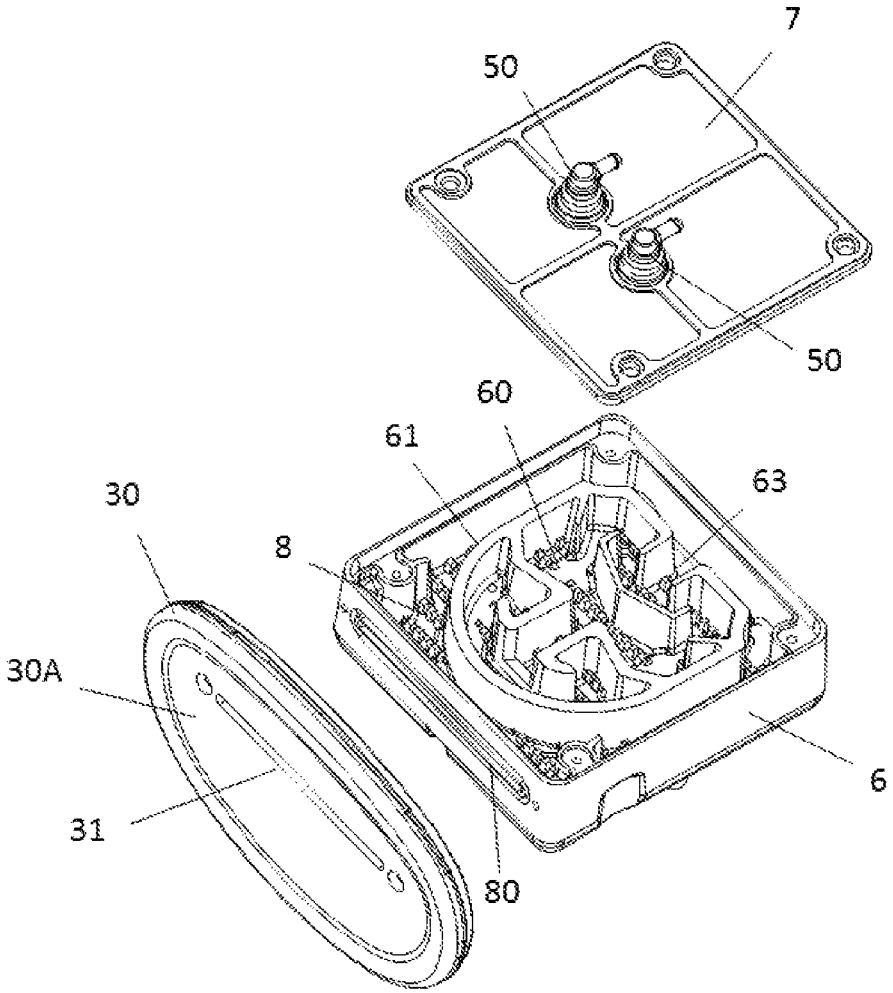
FIG. 3 is an exploded perspective view of the heating body that forms part of the appliance shown in FIG. 1.
Figure 4:
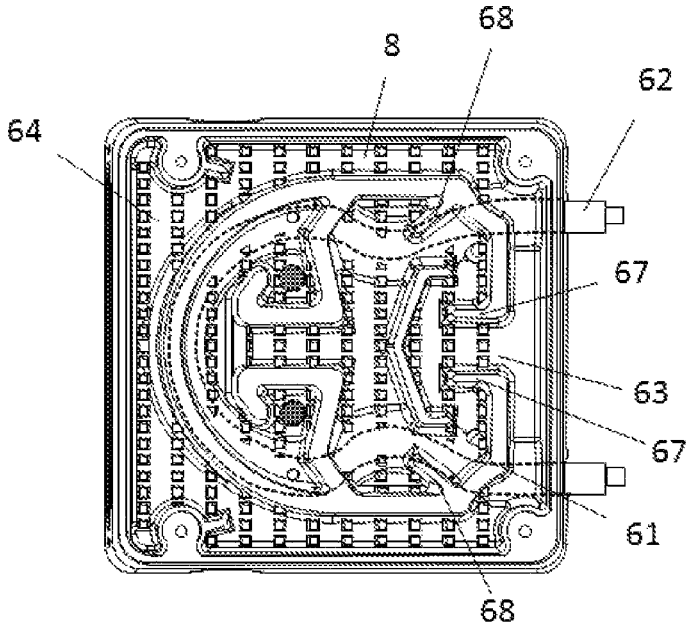
FIG. 4 is a bird's eye view of the heating body without its closure cover.

In accordance with FIGS. 3 and 4, the heating body 6 creates an enclosure in the middle of which there is a vaporization chamber 60, with the sides of the vaporization chamber being defined by a peripheral wall 61 with a semi-circular front end and a straight-lined rear end, whereby the vaporization chamber 60 is closed at its upper end by the lid 7, with the lid sitting hermetically on the top of the peripheral wall 61.

Within the compartment of the heating body 6 and outside the peripheral wall 61 on opposite sides of the vaporization chamber 60 is a volume that defines a distribution circuit 8. Through the distribution circuit volume, the vapor produced by the vaporization chamber 60 can flow in the direction of a light 80 housed in the front side of the heating body 6, as shown in FIG. 3. The shape of the light 80 corresponds to the shape of the steam release slot 31 on the treatment head 30A on the nozzle 3 of the appliance.

The heating body 6 is advantageously made up of an aluminum casting in which an electrical resistor 62 is submerged, whereby the electrical resistor 62 is a U-shaped armored type resistor, with a power within a range extending from 1200 W to 2000 W and preferably on the order of 1800 W. The power supply fed through the electrical resistor 62 is controlled by a thermostat, not shown in the Figures. The thermostat measures a temperature at the center of the vaporization chamber 60. Further, a temperature measured by the thermostat is kept at a set-point temperature ST, i.e., a predetermined temperature. Preferably, the user cannot adjust the set-point temperature ST value, which is preferably set to a value between 110° C. and 180° C. The set-point temperature may be a single value or a range of values. When the set-point temperature is a range of values, it may be a predetermined temperature range. In some embodiments, the set-point temperature is 150° C. In some embodiments, the set-point temperature is 140° C. In some embodiments, the set-point temperature is 145° C. In other embodiments, the set-point temperature may be any value between 110° C. and 180° C. In some embodiments, the set-point temperature is a temperature range between 140° C. and 145° C. In some embodiments, the set-point temperature is a temperature range between 145° C. and 150° C. In some embodiments, the set-point temperature is a temperature range between 144° C. and 146° C. In other embodiments, the temperature range may encompass a range between a low-end and a high-end of anywhere between 1° C. to 10° C. where the low-end temperature may be anywhere between 110° C. and 180° C.

The thermostat may be a bimetal mechanical thermostat, which may be attached to the wall at the bottom of the vaporization chamber 60. Alternatively, the thermostat may be a CTN temperature sensor, provided in place of the mechanical thermostat, which is connected to an electronic board that controls the electrical resistor 62.

The thermostat is connected to the power supply board 9 and through the power supply board, is also connected to the pump 5. In some examples, a wire connection transmits information from the electrical resistor 62 to the pump 5 regarding the status of power supplied to the resistor. In some embodiments, the thermostat and the power supply board may be configured so that the thermostat transmits information regarding whether or not current is passing through the resistor. In some embodiments, the thermostat and the power supply board may be configured so that the thermostat transmits information regarding a current temperature of the vaporization chamber based on a reading of the thermostat. As described in greater detail in the description of the method, the power supply board 9 may be configured in certain embodiments to control an operating mode of the pump from among two, three or more operating modes based on whether the current temperature falls within a temperature range associated with a particular operating mode.

The heating body 6 may likewise comprise a fuse that cuts the electric power supply from the electrical resistor 62 in the event that the thermostat fails, whereby this fuse may blow, for example, when the temperature of the heating body 6 exceeds 250° C.

Figure 5:
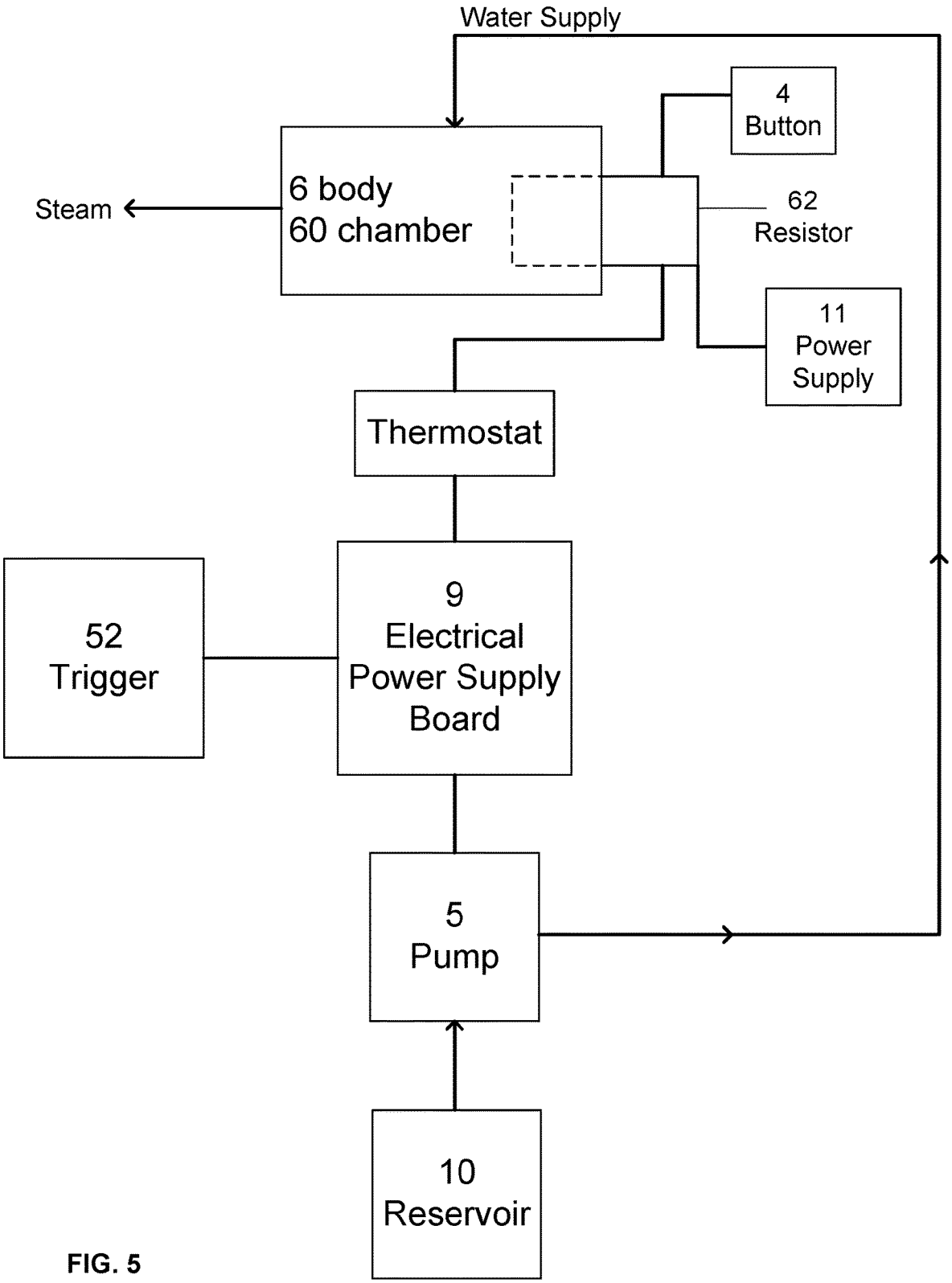
FIG. 5 is a flow diagram illustrating the operational relationship of the components of the pressing appliance.

In another aspect, the present disclosure relates to a method of operating the steaming appliance. A flow diagram illustrating one example of the relationship of the appliance components as applicable during use of the appliance is shown in FIG. 5. In one embodiment of the method, the power supply board 9 for the pump 5 includes a microprocessor that sets an operating process into motion, as described below.

When the appliance begins to work upon the button 4 being pressed, the appliance initiates a pre-heating stage in which the electrical resistor 62 in the vaporization chamber 60 is supplied with current until the temperature of the vaporization chamber 60 reaches the set-point temperature ST, whereby the thermostat regulates the electrical resistor 62 so that the temperature of the vaporization chamber remains close to the set-point temperature ST.

Preferably, throughout this pre-heating stage, use of the trigger 52 does not give rise to the pump 5 operating until the temperature of the vaporization chamber 60 has reached the set-point temperature ST. Thus, in some embodiments, once the trigger is pulled, the power supply board communicates with the thermostat, and if a temperature measured by the thermostat is below the set-point temperature, then the power supply board will not instruct the pump to operate. This function is programmed into the power supply board. In other embodiments, when the power supply board communicates with the thermostat in response to pulling of the trigger, the power supply board may instruct the pump to operate at any temperature above a predetermined activation temperature that is itself below the set-point temperature. Although described above as applied to the pre-heating stage, the above control to prevent activation of the pump below a particular temperature of the vaporization chamber 60 may be included as part of the function of the appliance even after pre-heating in the event that the temperature of the chamber drops despite the control provided by the thermostat and current through the chamber. The inclusion of this feature is yet another way that the appliance prevents liquid buildup in the chamber when the temperature within the chamber is too low to evaporate some or all of the liquid.

Once the pre-heating stage is completed, the temperature of the vaporization chamber 60 is maintained at or near the set-point temperature ST by the thermostat, whereby the thermostat cuts the power supply to the electrical resistor 62 when the temperature measured exceeds the set-point temperature ST and, conversely, whereby the thermostat feeds current through the electrical resistor 62 when the temperature measured is lower than the set-point temperature ST. A similar control applies when, as applicable in some examples, the set-point temperature is a predetermined temperature range.

If the user presses the trigger 52 once the pre-heating stage has come to an end, the power supply board 9 causes the pump 5 to start operating in a flow mode that corresponds to whether or not power is supplied through the electrical resistor 62.

When the trigger 52 is pressed and the thermostat sends information back to the power supply board 9 that indicates that power is being supplied to the electrical resistor 62, the power supply board 9 causes the pump 5 to start operating in a first flow mode, or in other words, in maximum flow mode, which, in one example, beneficially falls in the order of 40 g/min.

When the trigger 52 is pressed and the thermostat sends information back to the power supply board 9 that indicates that no power is being supplied to the electrical resistor 62, the power supply board 9 causes the pump 5 to start operating in a second flow mode, or in other words, in reduced flow mode, which, in one example, beneficially falls in the order of 15 g/min. By way of example, the reduced pump 5 flow could be obtained using a time wheel for the power supply to the pump 5. For both the maximum flow mode and the reduced flow mode, it should be appreciated that the flow rate may vary from the aforementioned exemplary values. For example, the maximum flow mode may have a flow rate from within a range between 20 g/min and 50 g/min.

If the power supply to the electrical resistor 62 changes while the trigger 52 is still being pressed by the user, the power supply board 9 adapts the flow of the pump 5 accordingly, in accordance with the operating norms set out above.

As such, the appliance makes it possible to produce a high steam flow with a vaporization chamber that has a low thermal mass, while also limiting the risks of water leaking out of the steam holes.

Indeed, when no current passes through the electrical resistor 62, the thermal energy stored in the mass of the heating body 6 is relied upon to ensure that the water injected into the vaporization chamber 60 evaporates. Thus, even though the heating body 6 has a lower evaporation capacity due to its light weight, which is itself advantageous due to its ergonomic benefits and its ease of use relative to heavier appliances, the lower flow rate mode compensates for the evaporation characteristics of the light weight body.

In particular, when current is not supplied through the resistor, the reduced flow rate of the pump reduces the risk that water does not evaporate in the chamber.

The steaming appliance is therefore advantageous in that it improves performance, given that it has a higher flow of steam, meanwhile retaining a low weight and limiting the risk of water leaking out as a result of the water injected into the vaporization chamber not being fully evaporated.

When understood correctly, the disclosure is never limited to the embodiment described and illustrated, since this embodiment was only provided by way of example. It is still possible to make amendments, specifically in terms of the way in which the various elements are composed or in terms of substituting equivalent techniques, provided that they remain within the scope of the disclosure.

In some embodiments of the method, the flow mode of the pump is controlled by a temperature of the vaporization chamber transmitted to the power supply board via the thermostat. In this arrangement, the operating mode, i.e., flow rate, is determined by temperature instead of whether or not current flows through the resistor. In certain variations, the appliance may be operated with two operating modes, the applicable mode determined by whether or not a temperature is above or below a particular value. In other variations, the appliance may have three or more operating modes, each corresponding to a unique range of temperatures and initiated when a temperature measured by the thermostat falls within the applicable range and is relayed to the pump through the power supply board.

In an alternative embodiment, a flow rate of the maximum flow mode of the pump may be adjusted using a button provided to this end.

Similarly, in an alternative embodiment that has not been depicted, the reservoir and potentially the pump, may be moved onto a separate base, whereby the base is connected to the steam release nozzle by a tube, thus allowing the water in the reservoir to circulate towards the vaporization chamber.

Furthermore, in this respect, in an alternative embodiment that has not been depicted, the pressing appliance may be an iron comprising a metal base that comes into thermal contact with the heating body.

Although the disclosure herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

The invention claimed is:

1. A steam pressing appliance comprising:

a handle;

a steam release nozzle connected to the handle, the steam release nozzle including a heating body and a treatment head with at least one steam output hole, the heating body comprising:

a vaporization chamber; and a resistor regulated by a thermostat in order to keep a temperature of the vaporization chamber within a predetermined temperature range; and an electric pump connected to the vaporization chamber, wherein the thermostat and the electric pump are both connected to a drive circuit, and wherein the drive circuit, when in receipt of a signal to activate the electric pump, determines whether electrical current is flowing through the resistor and, when current is flowing through the resistor, causes the electric pump to operate in a first flow mode and, when no current is flowing through the resistor, causes the electric pump to operate in a second flow mode different from the first flow mode.

2. The steam pressing appliance of claim 1, further comprising a button connected to the drive circuit, actuation of the button being actuatable to send the signal to the drive circuit to start pump operation.

3. The steam pressing appliance of claim 2, wherein the button is a trigger so that while the trigger is depressed, the pump is in operation, and while the trigger is released, the pump is not in operation.

4. The steam pressing appliance of claim 1, wherein the second pump flow mode is intermittent supply of power to the pump.

5. The steam pressing appliance of claim 1, wherein the second pump flow mode has a second flow rate that is at least 50% of a first flow rate of the first pump flow mode.

6. The steam pressing appliance of claim 1, wherein a flow rate of the first pump mode is between 20 and 50 g/min.

7. The steam pressing appliance of claim 1, wherein the treatment head is supported by an end plate located at one longitudinal edge of the steam release nozzle.

8. The steam pressing appliance of claim 1, further comprising a portable case, the portable case including the steam release nozzle, the handle, the heating body, the pump, the drive circuit and a fluid reservoir.

9. The steam pressing appliance of claim 1, wherein the second flow mode has a lesser flow rate than the first flow mode.

10. The steam pressing appliance of claim 1, wherein the drive circuit is configured to determine whether electrical current is flowing through the resistor by a process that includes communicating with the thermostat.

11. A steam pressing appliance comprising:

a housing structure with a heating body disposed therein;

a pump connected to the heating body; and an electrical power supply board in communication with the heating body and the pump, wherein when the steam pressing appliance is supplied with power, a temperature of the heating body is regulated to be within a predetermined temperature range, the temperature being regulated through control of current supplied through the heating body, wherein when the steam pressing appliance is supplied with power and a switch is toggled to activate the pump, the electrical power supply board communicates with the heating body to determine a condition of the heating body, and wherein when the switch is activated, the electrical power supply board determines whether the heating body is in a first condition, defined by current flowing through the heating body, or a second condition, defined by no current flowing through the heating body, and the pump operates in a first flow mode when the heating body is in the first condition and in a second flow mode when the heating body is in the second condition, the first flow mode being different from the second flow mode.

12. The steam pressing appliance of claim 11, wherein the first condition is a first temperature range and the second condition is a second temperature range below the first temperature range.

13. The steam pressing appliance of claim 12, wherein the first temperature range has a low end of at least 110° C.

14. The steam pressing appliance of claim 12, further comprising a third condition recognizable by the electrical power supply such that the first, second and third conditions represent distinct temperature ranges each associated with distinct flow modes.

15. The steam pressing appliance of claim 11, wherein current through the heating body generates heat in portions of a frame of the heating body in direct contact with fluids supplied into the heating body by the pump so that a temperature of fluids in the heating body is approximately the same as the temperature of the heating body.

16. The steam pressing appliance of claim 11, wherein the pump and the electrical power supply board are both disposed within the housing structure.

17. A steam pressing appliance comprising:

a base with a handle;

a nozzle extending from the base;

a heating body disposed within the nozzle and including a resistor formed in the heating body, the resistor being connected to a temperature measurement device such that power is supplied to carry current through the resistor when a temperature of the heating body as measured by the temperature measurement device is below a predetermined temperature range;

a pump in communication with the heating body; and a control mechanism connected to a drive circuit, the drive circuit being in communication with the heating body and the pump, wherein the control mechanism controls activation of the pump such that when the pump is activated, one of a first operational mode and a second operational mode is automatically initiated, wherein the first operational mode of the pump is initiated when the resistor is supplied with current and the second operational mode of the pump is initiated when the resistor is not supplied with current, the first operational mode having a first flow rate and the second operational mode having a second flow rate lower than the first flow rate, and wherein the drive circuit prevents the pump from operating when the temperature of the heating body measured by the temperature measurement device is below the predetermined temperature range.

18. The steam pressing appliance of claim 17, wherein the predetermined temperature range is a predetermined interval from within a range inclusive of 110° C. to 180° C.

19. The steam pressing appliance of claim 17, wherein the control mechanism controls activation of the pump only when the temperature of the heating body is no less than a lower end of the predetermined temperature range.

20. The steam pressing appliance of claim 17, wherein the heating body is adapted to be pre-heated prior to operation of the pump such that the control mechanism is inoperative until the heating body is pre-heated to the predetermined temperature range.

* * * * *